US006854535B1

(12) United States Patent
Mizuno

(10) Patent No.: US 6,854,535 B1
(45) Date of Patent: Feb. 15, 2005

(54) BORE LOCATION SYSTEM AND METHOD OF CALIBRATION

(75) Inventor: Morio Mizuno, Higashi-Machi (JP)

(73) Assignee: Merlin Technology, Inc., Renton, WA (US)

( * ) Notice: Subject to any disclaimer, the term of this patent is extended or adjusted under 35 U.S.C. 154(b) by 0 days.

(21) Appl. No.: 10/308,673

(22) Filed: Dec. 3, 2002

(51) Int. Cl.[7] ..... E21B 47/02; G01V 3/18; G01V 3/34

(52) U.S. Cl. ..... 175/62; 175/45; 166/255.2; 340/853.4; 340/853.6; 73/152.45; 324/369

(58) Field of Search ..... 175/24, 40, 45, 175/62; 166/250.01, 225.1, 255.2; 340/853.3, 853.4, 853.6, 856.1, 856.3; 73/152.01, 152.43, 152.45, 152.46; 324/351, 369

(56) References Cited

U.S. PATENT DOCUMENTS 3,746,106 A * 7/1973 McCullough et al. .... 340/853.5
4,881,083 A * 11/1989 Chau et al. ..... 342/459
4,993,503 A * 2/1991 Fischer et al. ..... 175/62
5,133,417 A * 7/1992 Rider ..... 175/45
5,155,442 A * 10/1992 Mercer ..... 324/690
5,264,795 A * 11/1993 Rider ..... 324/326
5,320,180 A * 6/1994 Ruley et al. ..... 175/26
5,363,926 A * 11/1994 Mizuno ..... 175/45
5,469,155 A * 11/1995 Archambeault et al. . 340/853.4
5,585,726 A * 12/1996 Chau ..... 324/326
5,711,381 A * 1/1998 Archambeault et al. ..... 175/45
5,767,678 A * 6/1998 Mercer ..... 324/326
5,880,680 A * 3/1999 Wisehart et al. ..... 340/853.4
5,993,008 A * 11/1999 Hashimukai et al. ..... 353/61
6,102,136 A * 8/2000 Archambeault et al. ..... 175/45
6,279,668 B1 * 8/2001 Mercer ..... 175/45
6,411,094 B1 * 6/2002 Gard et al. ..... 324/326
6,417,666 B1 * 7/2002 Mercer ..... 324/326
6,427,784 B1 * 8/2002 Archambeault et al. ..... 175/45
6,668,944 B2 * 12/2003 Brune et al. ..... 175/45
2003/0063013 A1 * 4/2003 Jin et al. ..... 340/853.3

* cited by examiner

*Primary Examiner*—David Bagnell
*Assistant Examiner*—Jennifer Gay
(74) *Attorney, Agent, or Firm*—Michael Pritzkau

(57) ABSTRACT

A method for calibrating a pitch measurement of a horizontal underground bore location system includes providing a probe having a pitch sensor that measures deviation between a predetermined orientation and a measurement axis. A receiver has an antenna that detects a signal radiated by the probe and has receiver circuitry that detects the deviation from the received signal. A bore head is aligned with the predetermined orientation. The probe is placed in the bore head. The receiver detects the deviation when the bore head is aligned with the predetermined orientation. The receiver offsets deviation measurements thereafter detected from the probe by the measured deviation.

19 Claims, 12 Drawing Sheets

BORE LOCATION SYSTEM AND METHOD OF CALIBRATION

BACKGROUND OF THE INVENTION

The present invention relates generally to underground bore location systems. Those of ordinary skill in the art should recognize that the term "horizontal bore" refers to the excavation of a hole, typically for utilities or sewers, through the ground and to the excavated hole itself. The present invention relates generally to systems for excavating and locating such bores. Accordingly, unless otherwise indicated, the term "bore" as used herein refers to new bores and to existing buried utilities, sewer lines or similar lines.

Bore location systems are utilized in a variety of circumstances. For example, when horizontal boring systems are used for installing utilities and sewer lines, it is desirable to maintain a directional boring head in a desired boring path and to avoid known obstacles such as existing utilities. Accordingly, systems are known to trace existing utilities from an above-ground position.

A boring head, which may include a boring probe behind a drill head, is underground during use and is therefore not visible to the operator. Accordingly, the boring probe may be configured to transmit signals from the bore that provide location information to an above-ground operator. One system that is configured to determine whether an underground boring probe is laterally offset from its intended horizontal path is described in U.S. Pat. No. 4,881,083, the entire disclosure of which is incorporated herein by reference. This information is used, in turn, to maintain the boring head in its desired path. When drilling underground horizontal bores for installation of water lines that operate by gravity flow, for example sewer lines, greater accuracy in the bore's location and direction is typically needed.

SUMMARY OF THE INVENTION

The present invention recognizes and addresses disadvantages of prior art constructions and methods. Accordingly, it is an object of the present invention to provide an improved bore location system.

This and other objects are achieved by a method for calibrating a boring probe's position in a bore head. A method according to an embodiment of the present invention includes aligning a probe in a bore head. The probe has a pitch sensor that measures the deviation between a predetermined orientation (the "first predetermined orientation") and a measurement axis defined by the pitch sensor and has a transmitter that radiates an electromagnetic signal that carries the deviation measured by the pitch sensor. A receiver is provided that receives the electromagnetic signal and detects the measured deviation. The receiver is aligned in a predetermined orientation (the "second predetermined orientation") with respect to the probe. The deviation is measured between the first predetermined orientation and the measurement axis. The deviation signal generated by the probe is received at the receiver, and the deviation signal is stored in memory as a calibration error.

In another embodiment, a probe is provided that has a pitch sensor that measures deviation between a predetermined orientation and a measurement axis defined by the pitch sensor and has a transmitter that radiates an electromagnetic signal that carries the deviation pitch sensor. A receiver is provided that has at least one antenna and that detects the signal radiated by the probe and has receiver circuitry that detects the deviation from a signal output from the antenna. A bore head is aligned with the predetermined orientation. The probe is placed in the bore head. The receiver thereafter detects the deviation when the bore head is aligned with the predetermined orientation. The receiver offsets deviation measurements thereafter detected by the probe by the measured deviation.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended drawings, in which.

Figure 1:
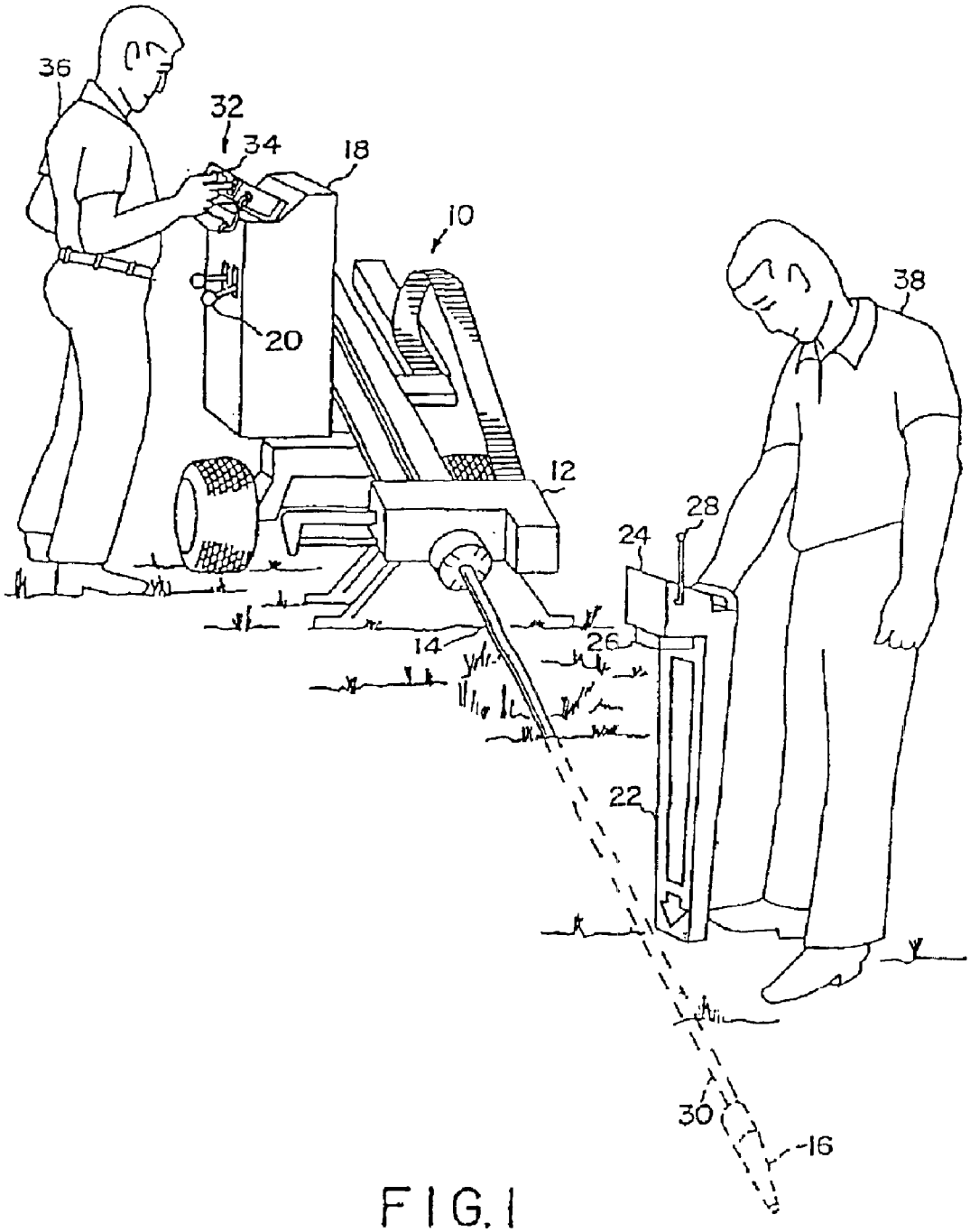
FIG. 1 is a perspective view of a wireless remote boring system in accordance with an embodiment of the present invention.

Repeat use of reference characters in the present specification and drawings is intended to represent same or analogous features or elements of the invention.

DETAILED DESCRIPTION

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 illustrates a directional boring device 10 in accordance with an embodiment of the present invention. A boring machine 12 is located in an initial position and includes a drill string 14 and a directional boring head 16. The boring machine includes a control panel 18 with actuators 20 for controlling operation of the boring device. A signal generating probe 30 is located in boring head 16 for emitting location signals containing information about the boring device as will be discussed in more detail below. The probe may be placed in a cavity in the boring head if the boring head is so configured. Alternatively, a drill string rod may be formed with a cavity to receive the probe and placed behind the boring head so that the orientation of the rod corresponds to the orientation of the boring head. It should be understood that the probe is considered to be "in" the boring head in either arrangement.

Figure 9:
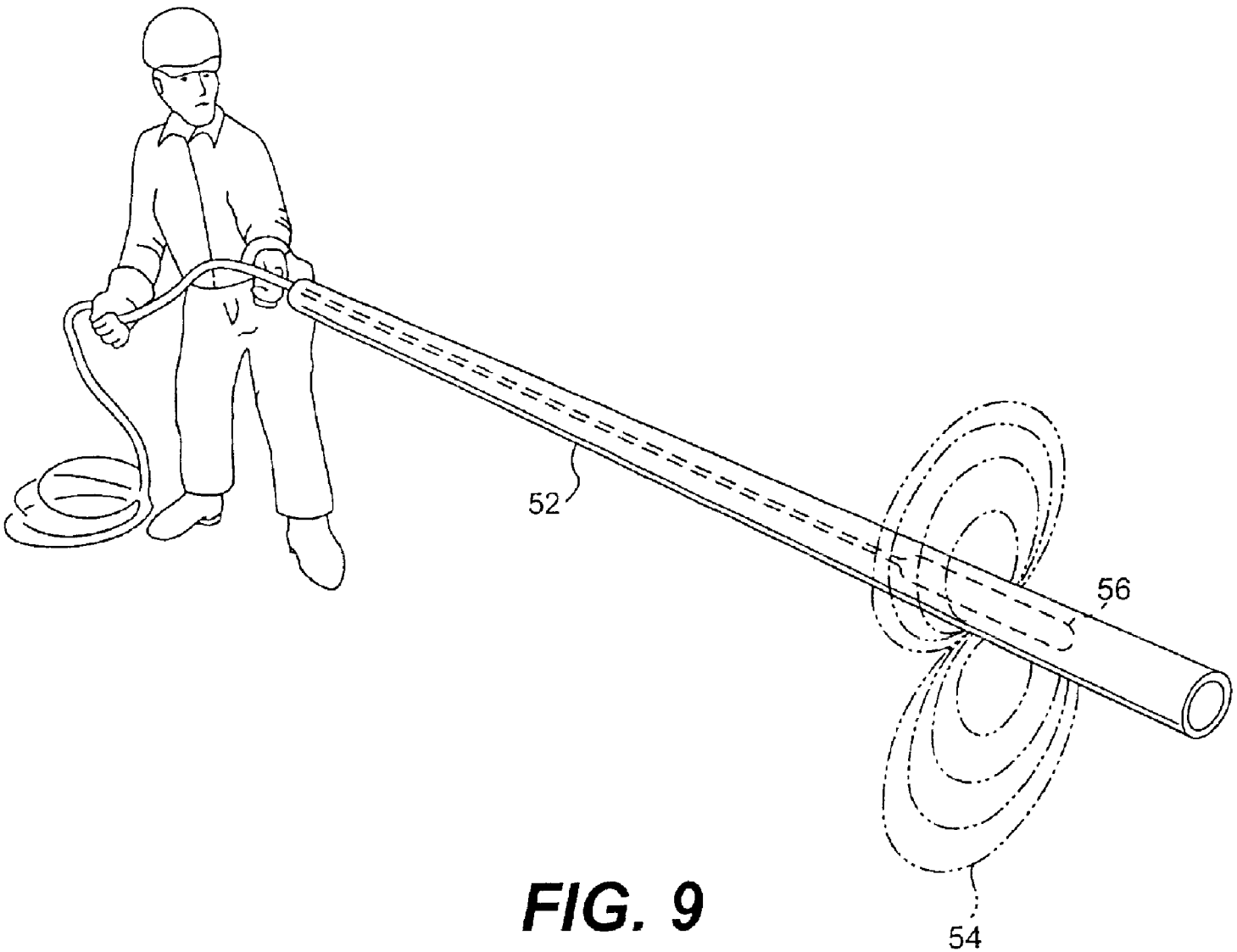
FIG. 9 is a schematic illustration of a transmitting source.

In addition to their use in boring heads for drilling new bores, a signal generating probe may be attached at the front of a length or lengths of fiberglass rods, know as a "duct rodder," as indicated at 56 in FIG. 9, and passed through an existing bore 52 to identify the bore's location by emitting a signal 54 that is received above ground. Typically, probes that are run through existing bores are not used for measuring pitch. A probe may, however, be used to measure pitch in an existing bore, for example when it is desired to map the bore, and may be placed in a head for passage through the bore. Thus, although the embodiments described herein are presented generally in the context of a head used for boring, it should be understood that this is for purposes of convenience of explanation, and heads used in boring and non-boring circumstances should be understood to be within the meaning of a "bore head" as used herein.

A means for wireless receipt of location signals from the signal generating probe includes a receiver 22. Receiver 22 includes a display 24 and means for wireless transmission from the receiver device to a remote monitor device of information received from the probe. As embodied herein, the means for wireless transmission includes a wireless transmitter 26 with an antenna 28.

The guidance system further includes a remote monitoring device 32 located generally adjacent to boring machine 12 for receiving the transmitted information from transmitter 26 via wireless transmission. Remote monitor 32 includes a display 34 so that the operator 36 of the boring device can see and/or hear the information transmitted from transmitter 26.

Accordingly, a workman 38 at a distant location from the boring machine 12 utilizes receiver 22 to receive a location signal from signal generating probe 30, which signal contains information with respect to the boring head 16. Such information may be, for example, its location, its depth below the ground, its pitch, its angular position or roll, its temperature, and/or the remaining battery life of the probe. This information is received by receiver 22 as will be described in more detail below and is processed on display 24 at this location.

Substantially simultaneously and in real time, transmitter 26 transmits signals carrying the information that is displayed on display 24 to the monitor 32 via wireless transmission.

Remote monitor 32 processes these signals and displays them on display 34. Both data and image signals may be transmitted between the wireless transmitter and remote monitor 32. Thus, operator 36 at the boring device is able to obtain real time information with respect to the boring head just as workman 38 is able to obtain this information at the location of the boring head. One or more example of boring systems and methods of operating such systems are described in U.S. Pat. No. 6,102,136 and pending U.S. patent application Ser. No. 091657,678, each of which is incorporated by reference in its entirety herein.

All suitable apparatus and methods for accomplishing the present invention should be understood to be in the scope and spirit of the present invention. For ease of explanation, however, the remainder of the specification will address an exemplary preferred embodiment for use with a directional boring system as shown in FIG. 1. It should be understood that such an example is provided by way of illustration only and not in limitation of the invention.

Figure 2A:
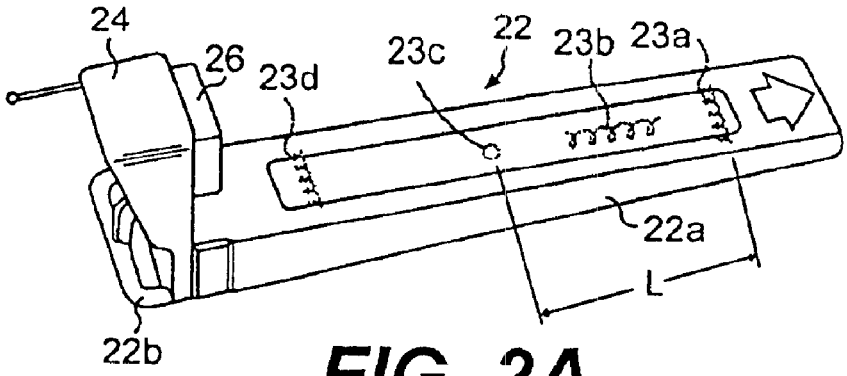
FIG. 2A is a perspective view of a receiver/transmitter for use in accordance with an embodiment of the present invention.
Figure 2B:
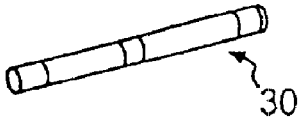
FIG. 2B is a perspective view of a signal generating probe for use in accordance with an embodiment of the present invention.

FIGS. 2A and 2B illustrate receiver 22 and signal generating probe 30. Receiver 22 includes a longitudinally extended plastic casing 22*a* that houses the receiving mechanism. Integrated with housing 22*a* is display 24 and a handle 22*b* for positioning the receiver. Attached to the receiver is wireless transmitter 26, the operation of which will be described in more detail with respect to FIG. 5. Of course, transmitter 26 may be incorporated within the receiver unit. Housing 22*a* includes a plurality of horizontally spaced-apart coils 23*a*, 23*b*, 23*c* and 23*d*(shown in phantom in FIG. 2A) for receiving signals from signal generating probe 30. Coils 23*a* and 23*d* extend parallel to each other in a side-to-side direction across the receiver. Coil 23*b* is perpendicular to coils 23*a* and 23*d* and is aligned longitudinally in the receiver. Coil 23*c* is perpendicular both to coils 23*a* and 23*d* and to coil 23*b* and is aligned in a front-to-back direction in the receiver.

Signal generating probe 30 generates a magnetic field that contains information used to locate and determine the depth of boring head 16. Prior to operation, the system is calibrated to this field to permit subsequent depth measurements. At calibration, an operator activates a calibration mode of operation at the receiver and places probe 30 ten feet from the receiver, laterally aligned with and parallel to coil 23*a*. In depth calibration mode, the receiver only measures the strength of the signal on coil 23*a* induced by the probe's radiated magnetic field. Receiver 22 (FIG. 5) stores this value (hereinafter "V1") in an EEPROM or other suitable memory at the receiver. Additionally, or alternatively, the receiver may transmit V1 to memory at monitor 32.

To determine the probe's depth during operation, the operator carries receiver 22 as shown in FIG. 1 and positions the receiver so that coil 23*a* is parallel to the probe's actual or intended path of travel. In a depth-reading mode, the receiver measures only the strength of the signal on coil 23*a* induced by the probe's radiated magnetic field and stores this value (hereinafter "V2") to memory at the receiver and/or monitor 32. A CPU at the receiver determines the probe's depth by the following equation:

$$\text{depth}=10\text{ ft }(V1/V2)^{1/3}$$

This value is displayed at displays 24 and 34.

It should be understood that depth may be calculated in any suitable manner. Thus, for example, coils 23*a* and 23*d* may utilize the field gradient of the magnetic field from the signal generator in a boring head to generate information as to the location and depth of the boring head as disclosed in U.S. Pat. No. 3,617,865 dated Nov. 2, 1971, the disclosure of which is incorporated herein by reference in its entirety. To measure the distance of an existing underground utility in an arrangement as shown in FIG. 9, the operator may place the receiver above the utility so that parallel coils 23*a* and 23*d* are perpendicular to the underground utility. In a depth-reading mode, the receiver measures only the strength of the signals on coils 23*a* and 23*d* induced by the magnetic field radiated from the utility. Assuming that the magnitude of these signals are V1 and V2, respectively, the receiver stores these values in its memory. The distance L between coils 23*a* and 23*d* is known and is also stored in the receiver s memory. The depth between coil 23*a* and the existing utility is equal to: L(V2/(V1−V2).

$$X=L(V2/(V1-V2))$$

It should also be understood that the control of coils 23*a*, 23*b*, 23*c* and 23*d* may be effected in any suitable means. For example, a CPU in the receiver may control the selection of coil outputs to an amplification and filter circuit, as shown in FIG. 9 of U.S. Pat. No. 5,363,926, the entire disclosure of which is incorporated by reference herein.

In a preferred embodiment, the frequency of the signal output by the signal generator in the probe is approximately 38 kilohertz (kHz). Any suitable frequency may be utilized, such as, for example, 1.2 kHz, 9.5 kHz, 114 kHz, etc.

Figure 3:
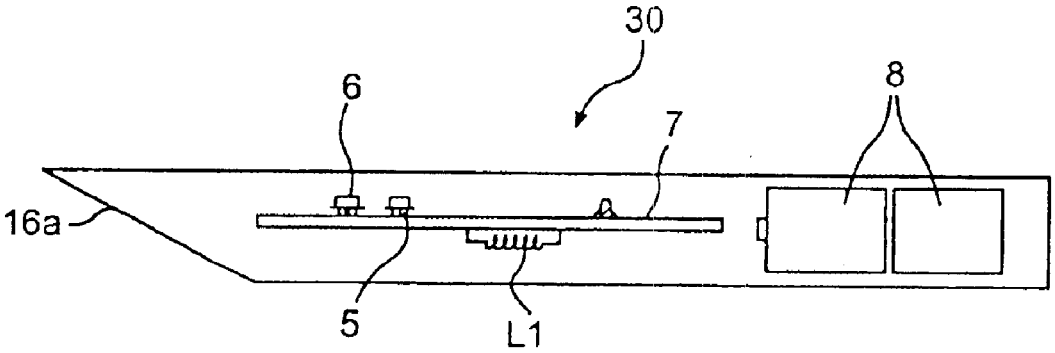
FIG. 3 is a schematic diagram of a signal generating probe in conjunction with a boring head for use with an embodiment of the present invention.
Figure 4:
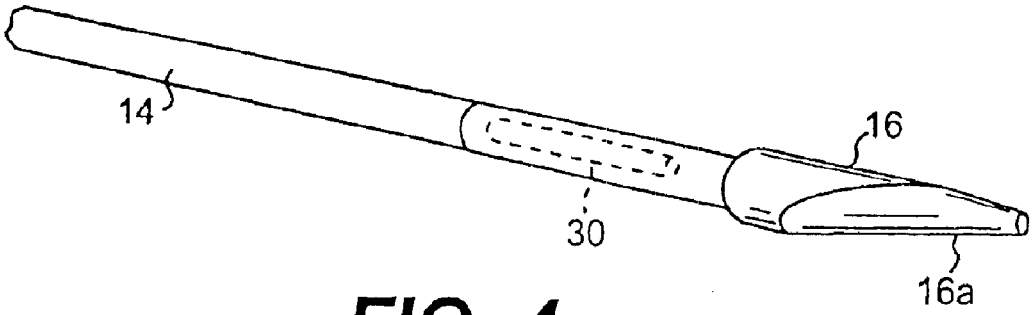
FIG. 4 is a perspective view of a directional boring head associated with a signal generating probe and drill rod for use with an embodiment of the present invention.

Probe 30 in a preferred embodiment includes an antenna comprised of a ferromagnetic core with copper windings on which an electrical current is placed to generate a dipole magnetic field that is received by receiver 22. Probe 30 may be of varying types depending on the application desired and may be capable of providing a variety of types of information. Mercury switches may be provided in probe 30 around its inside perimeter so as to indicate the angular position of the boring head about its longitudinal axis, or roll. When the boring head is rotated to a particular position, the appropriate mercury switches close and, therefore, angular position information is generated. As is indicated in FIGS. 3 and 4, a directional boring head 16 has a sloped portion 16*a* for controlling the direction of the boring head in conjunction with the propulsion of the boring machine. With information as to the boring head's angular location, the sloped portion can be oriented so that the boring head proceeds in a desired direction. Probe 30 may contain a cradle-type switch for indicating the deviation of the boring head above or below a horizontal plane. As used herein, the term "deviate" means a departure from a predetermined point of reference. For example, the pitch angle of a boring head is the deviation of the boring head from a predetermined orientation, e.g., horizontal.

Figure 3A:
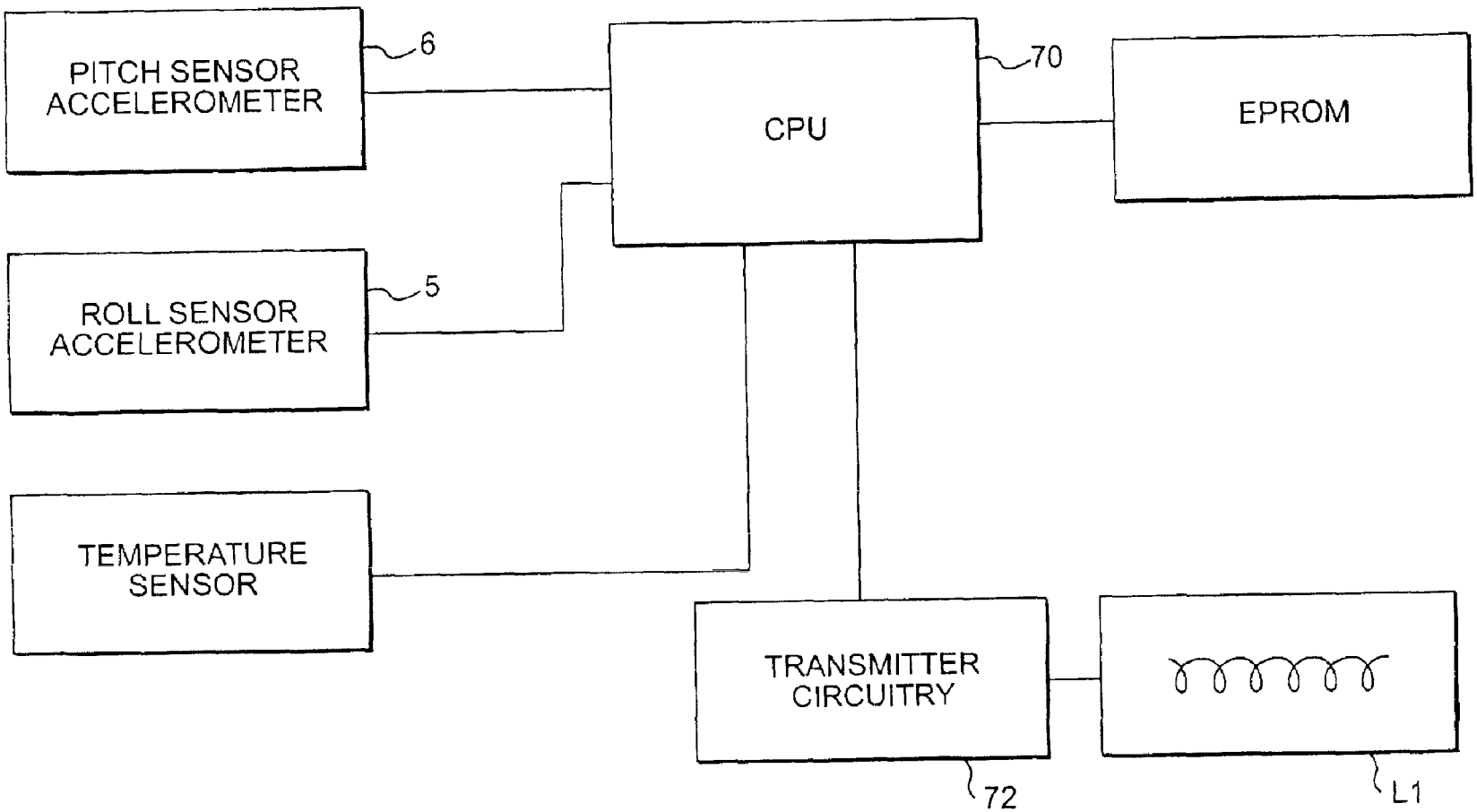
FIG. 3A is a block diagram partially illustrating circuitry in the signal generating probe as in FIG. 3.

As shown in FIG. 3, the cradle type and mercury switches may be replaced by accelerometers, for example model no. ADXL 202AQC from Analog Devices, Inc. of Phoenix, Ariz., for measuring the pitch and roll angle, although other accelerometers may be used. A roll angle accelerometer 5 is disposed on a printed circuit board 7, adjacent to batteries 8, so that the accelerometer's sensitive axis is aligned perpendicularly to the probe axis. A pitch angle accelerometer 6 is disposed so that its sensitive axis is parallel, and preferably coincident, with the probe axis. As should be well understood in this art, an accelerometer provides an analog voltage output that varies with the gravitational force applied along its sensitive axis. The gravitational force, in turn, varies as a function of the angle between the sensitive axis and horizontal. In one preferred embodiment, pitch accelerometers for use in drilling or locating sewer lines react to an acceleration force of 0.00 lg or less. Thus, and referring also to FIG. 3A, a central processing unit (CPU) 70 disposed on circuit board 7 receives the voltage signals that are output from roll and pitch accelerometers 5 and 6, digitally converts the analog signals, determines the output signal levels, and converts this information to pitch and roll angles according to a calibrated conversion function for the particular accelerometer type. The CPU then digitally encodes the angle information and modulates the carrier signal radiated from coil L1 to transmit the angles to the above-ground receiver. In a preferred embodiment, the CPU modulates the coil signal through transmitter circuitry 72 using frequency shift keyed modulation. Various modulation techniques and encoding methods could be practiced with the present invention, as should be recognized by those skilled in this art. The particular methods are not, in and of themselves, critical and are therefore not discussed in detail herein.

The probe's CPU measures the pitch and roll angles by sampling the respective accelerometer's output over a sampling period and averaging the results. The particular sampling routine may vary, depending on the purpose of the measurement. For example, a more precise pitch angle measurement is sometimes desired for probes used in water flow lines such as sewers, in which gravity-dependant water flow requires the existence of an incline in the line. Accordingly, the sampling process is modified in such probes (referred to herein as "sewer" probes for ease of explanation) to provide a higher resolution measurement within a certain range of pitch angles.

For example, CPU 70 samples the output of pitch accelerometer 6 at an average rate of 24 samples, but whereas the CPU in a "standard" probe (i.e. a probe for use in environments in which higher resolution is not needed) may sample the accelerometer over an approximately one second sampling period, sewer probe CPU 70 samples over approximately a three second sampling period. More specifically, the standard probe samples the accelerometer 24 times before averaging the samples to determine the pitch, while the sewer probe CPU takes about 72 samples before determining an average. Of course, the increased sampling period results in increased processing time. Thus, the probe only relies on the increased number of samples when the probe is operating within a range of angles at which increased precision is needed, for example when the pitch angle is between −5 degrees and 5 degrees. It should be understood that the range may extend to either side of zero degrees by any amount, for example 15 degrees, or for the probe's entire measurement range, as desired. When the probe determines that the pitch angle is beyond the predetermined range, the probe switches back to the standard 24 samples-per-measurement. That is, and referring to the present example, the sewer probe automatically samples the pitch accelerometer at approximately 72 samples-per-measurement when the probe is initially activated. If the pitch is within −5 degrees to 5 degrees, the CPU continues to use the increased number of samples for each pitch measurement. However, when subsequent pitch measurements indicate that the probe is beyond this range, the CPU returns to the standard measurement (for example, 24 samples-per-measurement) and continues to operate at that level until pitch measurements indicate the probe is again within the −5 degree to 5 degree range.

The CPU converts the angle derived from the accelerometer samples to a digital number between 0 and 127 and associates the number with a plus or minus sign to indicate whether the pitch angle is above or below horizontal. The code numbers are stored in a look-up table in the probe's memory, as shown in the first and second columns in Table 1 below. The probe transmits the number to the above-ground receiver. The receiver, in turn, receives the measurement signal and converts the number for display either to a degree or percent value, as selected by the user. The degree and percent values (shown in the third and fourth columns in Table 1) are stored in a look-up table in the receiver's memory in association with the code numbers. In an alternative arrangement, the table stores only the degree values, and the receiver's CPU calculates the percent value from the corresponding degree value. In one preferred embodiment, the percent value is approximately equal to the tangent of the probe's actual pitch in degrees, multiplied by 100. That is, percent=100 TAN(actual pitch angle).

As illustrated in Table 1, the probe assigns pitch angle numbers at a 0.05 degree resolution between −5.7 degrees and 5.7 degrees. Within this range, pitch is measured at 72 samples-per-measurement between −5.0 degrees and 5.0 degrees. This is reflected by the change in the resolution of the display pitch angle values in column 3 from a 0.05 degree resolution to a 0.5 degree resolution beginning at 5.0 degrees. To provide a convenient transition in the percent value display (column 4) at 10 percent from a 0.1 percent resolution to a 1.0 percent resolution, however, the probe assigns pitch values at 0.05 degree increments up to 5.7 degrees, even though measurements beyond 5.0 degrees are derived from 24 samples-per-measurement.

Beyond 5.7 degrees, the resolution at which the probe assigns code numbers to pitch measurements varies. Additionally, the probe only measures pitch between −12.7 degrees and 12.7 degrees. The probe's operative range, and the particular resolution for the code number assignments, are chosen in the presently-described embodiment not only to accommodate the range of angles at which higher resolution is needed, but also for convenience in memory and to fit the output display discussed below. It should be understood, however, that other measurement methods may be employed and that the particular arrangement described herein is provided for purposes of example only.

TABLE 1

| Actual Probe Angle (degrees) | Probe Output Data | Receiver Pitch Display (degrees) | Receiver Pitch Display (percent) |
|---|---|---|---|
| 0 | 0 | 0 | 0 |
| 0.05 | 1 | 0.05 | 0.1 |
| 0.10 | 2 | 0.10 | 0.2 |
| 0.15 | 3 | 0.15 | 0.3 |
| 0.20 | 4 | 0.20 | 0.3 |
| 0.25 | 5 | 0.25 | 0.4 |
| 0.30 | 6 | 0.30 | 0.5 |
| 0.35 | 7 | 0.35 | 0.6 |
| - - - | | | |
| 4.95 | 99 | 4.95 | 8.6 |
| 5.00 | 100 | 5.00 | 8.7 |
| 5.05 | 101 | 5.00 | 8.8 |
| - - - | | | |
| 5.40 | 108 | 5.00 | 9.4 |
| 5.45 | 109 | 5.00 | 9.5 |
| 5.50 | 110 | 5.5 | 9.6 |
| 5.55 | 111 | 5.5 | 9.7 |
| 5.60 | 112 | 5.5 | 9.8 |
| 5.65 | 113 | 5.5 | 9.9 |
| 5.70 | 114 | 5.5 | 10.0 |
| 6.0 | 115 | 6.0 | 11.0 |
| 6.6 | 116 | 6.5 | 12.0 |

TABLE 1-continued

| Actual Probe Angle (degrees) | Probe Output Data | Receiver Pitch Display (degrees) | Receiver Pitch Display (percent) |
|---|---|---|---|
| 7.2 | 117 | 7.0 | 13.0 |
| 7.7 | 118 | 7.5 | 14.0 |
| 8.3 | 119 | 8.0 | 15.0 |
| 8.8 | 120 | 8.5 | 16.0 |
| 9.3 | 121 | 9.0 | 17.0 |
| 9.8 | 122 | 9.5 | 18.0 |
| 10.3 | 123 | 10.0 | 19.0 |
| 11.1 | 124 | 11.0 | 20.0 |
| 11.6 | 125 | 11.5 | 21.0 |
| 12.2 | 126 | 12.0 | 22.0 |
| 12.7 | 127 | 12.5 | 23.0 |

The receiver may be used either with a standard probe or a sewer probe. Thus, and as described in more detail below, the operator may set the receiver to a "standard probe" mode or a "sewer probe" mode, in which the receiver is configured to associate the signal received from the probe with the appropriate display values.

Finally, indicators may be contained in the boring head and probe to indicate the battery life remaining in the probe or signal generator as well as the temperature of the boring head. All of this information may be conveyed to the receiver through a dipole magnetic field generated by the signal generator, as described in U.S. Pat. No. 5,363,926 referenced above.

Referring to FIGS. 1 and 4, directional boring bead 16 is connected through drill string 14 to boring machine 12. A rear portion of the boring head defines a cavity into which the signal generating probe 30 may be inserted for generating the appropriate signals to convey the information with respect to the boring head as described above. Alternatively, the probe may be placed in a cavity defined within a boring rod immediately behind the boring head. As will be understood by those of ordinary skill in the art, as the boring head 16 advances through the bore, additional boring rods are added by operator 36. Thus, the progression of the boring head 16, and therefore the length of the bore, may be determined in terms of the number of boring rods expended.

Figure 5:
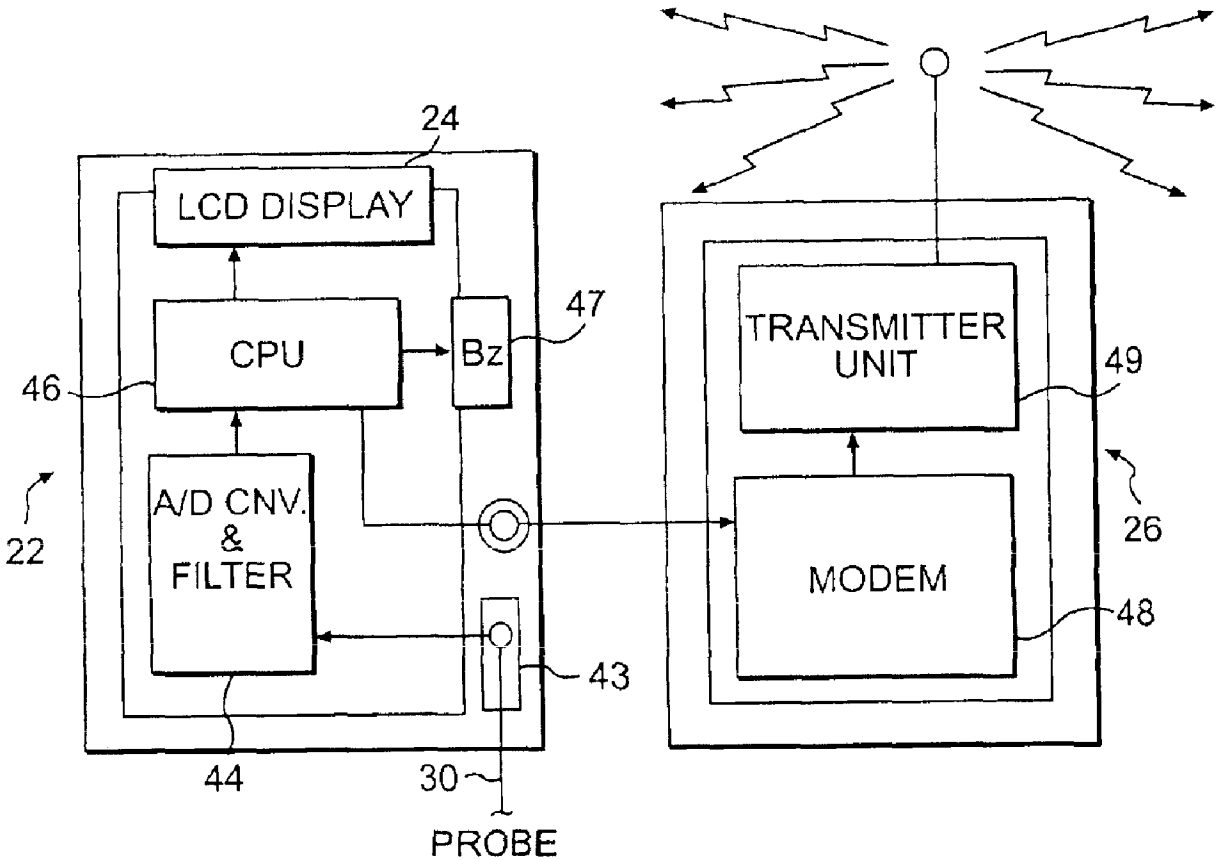
FIG. 5 is a block diagram illustrating the operation of a receiver/transmitter unit in accordance with an embodiment of the present invention.

FIG. 5 provides a block diagram illustration of the operational characteristics of receiver 22 and wireless transmitter 26 to one skilled in the art. As illustrated, receiver 22 receives a signal generated by signal generating probe 30 via magnetic field as described above. For receipt of pitch, roll, battery life and temperature information, the receiver relies on coil 23*a*, represented at 43 in FIG. 5. The signal received by coil 43 is filtered and converted from an analog signal to a digital signal at 44. The digital signal is then processed in a central processing unit 46 to generate an appropriate audible signal as illustrated at speaker 47 and an appropriate visual signal through display 24. The conversion of the received signals from the probe to a visual display and audible output as illustrated in FIG. 5 is done in a conventional manner as would be apparent to one skilled in the art and illustrated, for example, at FIG. 9 in U.S. Pat. No. 5,363,926 referenced above. One example of a known commercial product suitable for this function is the Micro Computerized Pipe Locator marketed by McLaughlin Manufacturing Co., Inc., 2006 Perimeter Road, Greenville, S.C. 29605.

Central processing unit 46 simultaneously and in real time conveys a signal representative of the information provided at display 24 and audible means 47 to wireless transmitter 26. Wireless transmitter 26 includes a frequency shift keyed modem 48 for receiving the signal from CPU 46 and a transmitter chip 49 for transmitting the signal via wireless means to remote monitor 32 (FIG. 1). In a preferred embodiment, the digital signal is transmitted between receiver 22 and transmitter 26 at 1200 bits per second. Also, in a preferred embodiment, between modem 48 and transmitter 49, the "1" component of the digital signal is transmitted on a frequency of 1500 Hz, and the "0", component of the digital signal is transmitted at approximately 2100 Hz. Of course, these are by way of example only.

Wireless transmitter 26 is capable of transmitting data and image signals and may be of any conventional type wireless transmitter with such capabilities. In a preferred embodiment, wireless transmitter 26 has selectable bands and transmits on a frequency of 469.50 MHz or 469.550 MHz with an output power of 18 milliwatts (mW). Of course, these are by way of example only. In a preferred embodiment, the transmitter circuit corresponds to the Federal Communications Commission Standard no. ID-APVO29O. The wireless transmitter is capable of transmitting both data and image signals and transmits the signals to the remote monitor 32 (FIG. 1) substantially simultaneously with the display on display 24, thereby providing real time information to the boring machine operator 36.

Figure 6:
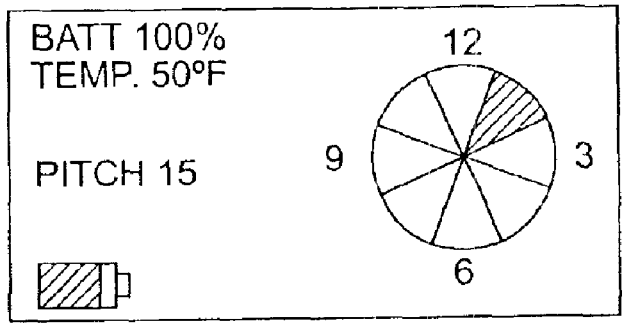
FIG. 6 is an exemplary visual display of a receiver and/or monitor device in accordance with an embodiment of the present invention.
Figure 7:
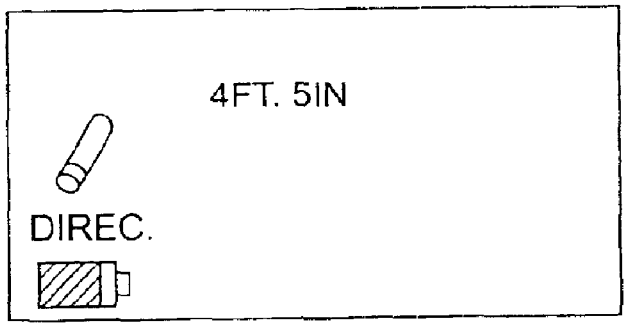
FIG. 7 is an exemplary visual display of a receiver and/or monitor device in accordance with an embodiment of the present invention.
Figure 8:
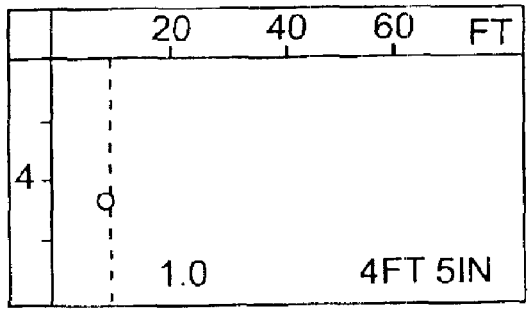
FIG. 8 is an exemplary visual display of a receiver and/or monitor device in accordance with an embodiment of the present invention.

FIGS. 6 to 8 illustrate exemplary visual displays of the receiver 22 and/or monitor 32.

The display in FIG. 7 illustrates the depth of the boring head at a particular instance. The display in FIG. 8 illustrates the depth of probe 30 plotted against the distance away from the boring apparatus. The display as in FIG. 6 illustrates the direction of the boring head's tapered surface and the boring head's pitch angle.

Errors in pitch generally arise from two sources. An operator may misalign the probe when installing the probe in the boring head such that the probe's longitudinal axis is not aligned exactly with the boring head's longitudinal axis. Additionally, the accelerometer may include inherent errors resulting from misalignment within the accelerometer itself during manufacture. In either case, the presently-described pitch angle calibration reduces the effect of these errors, allowing for more accurate bores.

Figure 11:
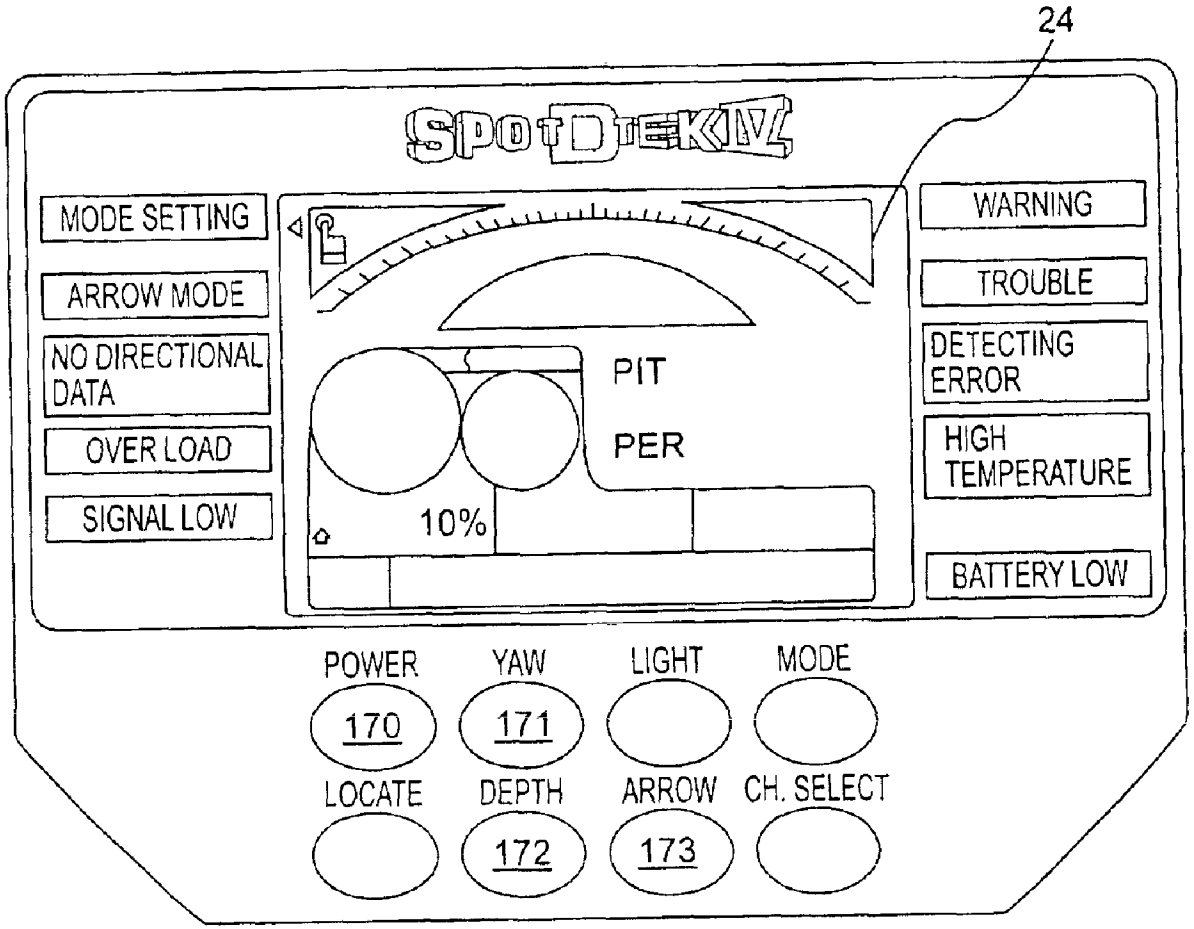
FIG. 11 is an exemplary visual display of a receiver and/or monitor device in accordance with an embodiment of the present invention.

As described above, sewer probes are more sensitive to changes in pitch and provide signals that produce pitch readings at a higher resolution. Thus, the receiver operates either in "standard" or "sewer" probe mode, depending on which type of signal it receives. The differences between these modes are (1) that the receiver's CPU recognizes the incoming pitch numbers to represent angles at a different resolution, (2) that the receiver displays the pitch angle to the appropriate decimal places, and (3) that the receiver offsets the pitch angle by a calibration error (described below) in sewer probe mode. Accordingly, the user can determine the receiver's present mode by observing the resolution of the pitch angle presented on the receiver screen. For example, if the resolution is in one-degree (1°) or one-percent (1%) increments as shown in FIG. 11 (notice that pitch the angle is shown without a tenth of a percent decimal), then receiver 22 is in standard probe mode. If a tenths decimal is shown, the receiver is in sewer probe mode. The display also indicates that the pitch (PIT) is being displayed as a percent (PER), as opposed to a value in degrees.

Figure 10:
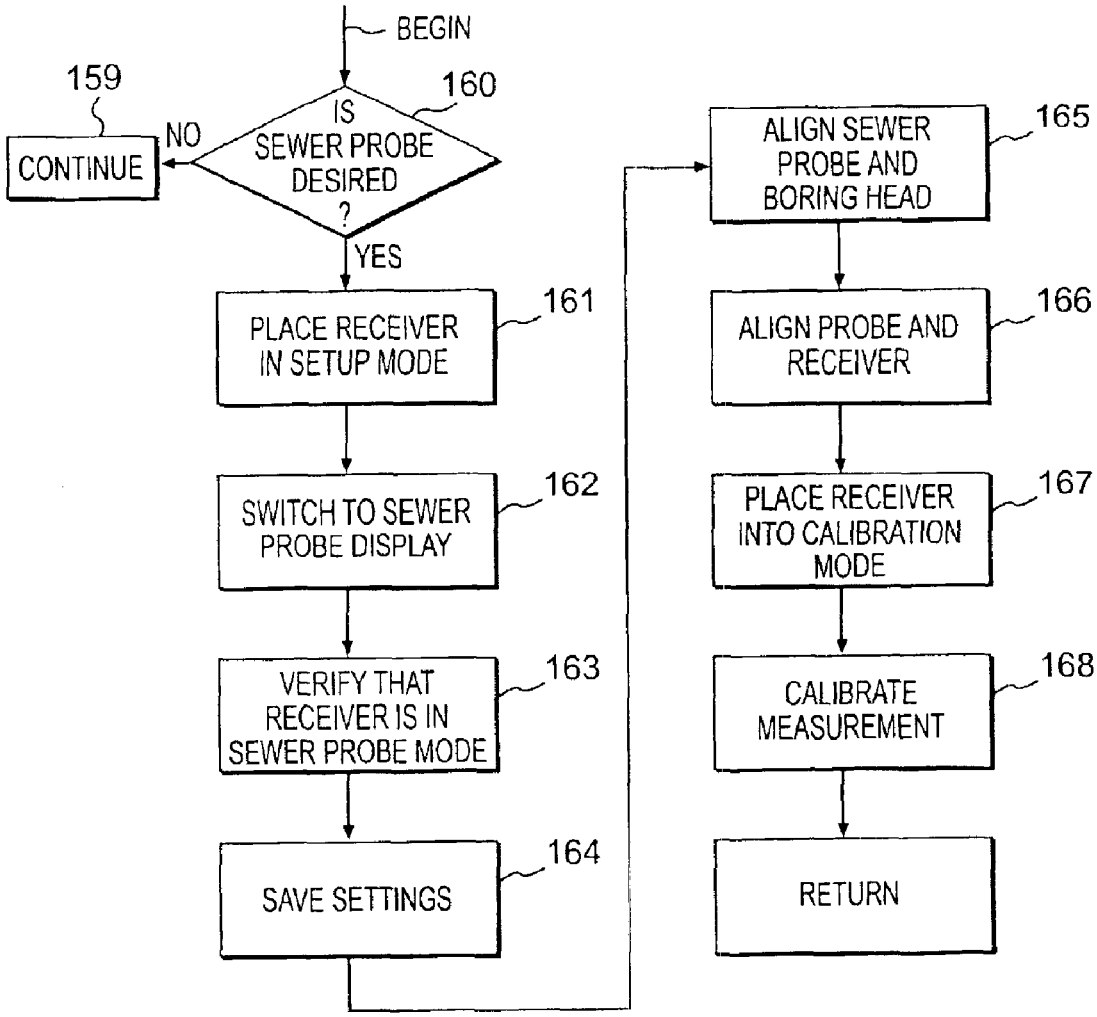
FIG. 10 is a flow diagram of a calibration process in accordance with an embodiment of the present invention.

Following initial power up, and referring also to FIGS. 10 and 11, the receiver is in the mode in which it was last used. If, at 160, the receiver is in standard mode, and the operator wishes to remain in standard mode, the operator calibrates the receiver for depth as described above and proceeds to operate the system at 159. If the operator wishes to switch from standard probe mode (FIG. 11) to sewer probe mode, the operator first switches the receiver to a setup mode, step 161, by first pressing a power button 170 (to turn the receiver off) and then pressing the same button (to turn the receiver on) while simultaneously pressing a yaw button 171. Although the receiver remains in standard mode at this point, the locator's microprocessor is now set to accept a command to change to sewer probe mode should the operator choose to give it. It should be understood that the receiver could be configured to toggle between standard and sewer probe modes without requiring a power down and power-up. In this embodiment, however, the power-down step reduces the likelihood that an operator inadvertently switches between the two modes.

Figure 12A:
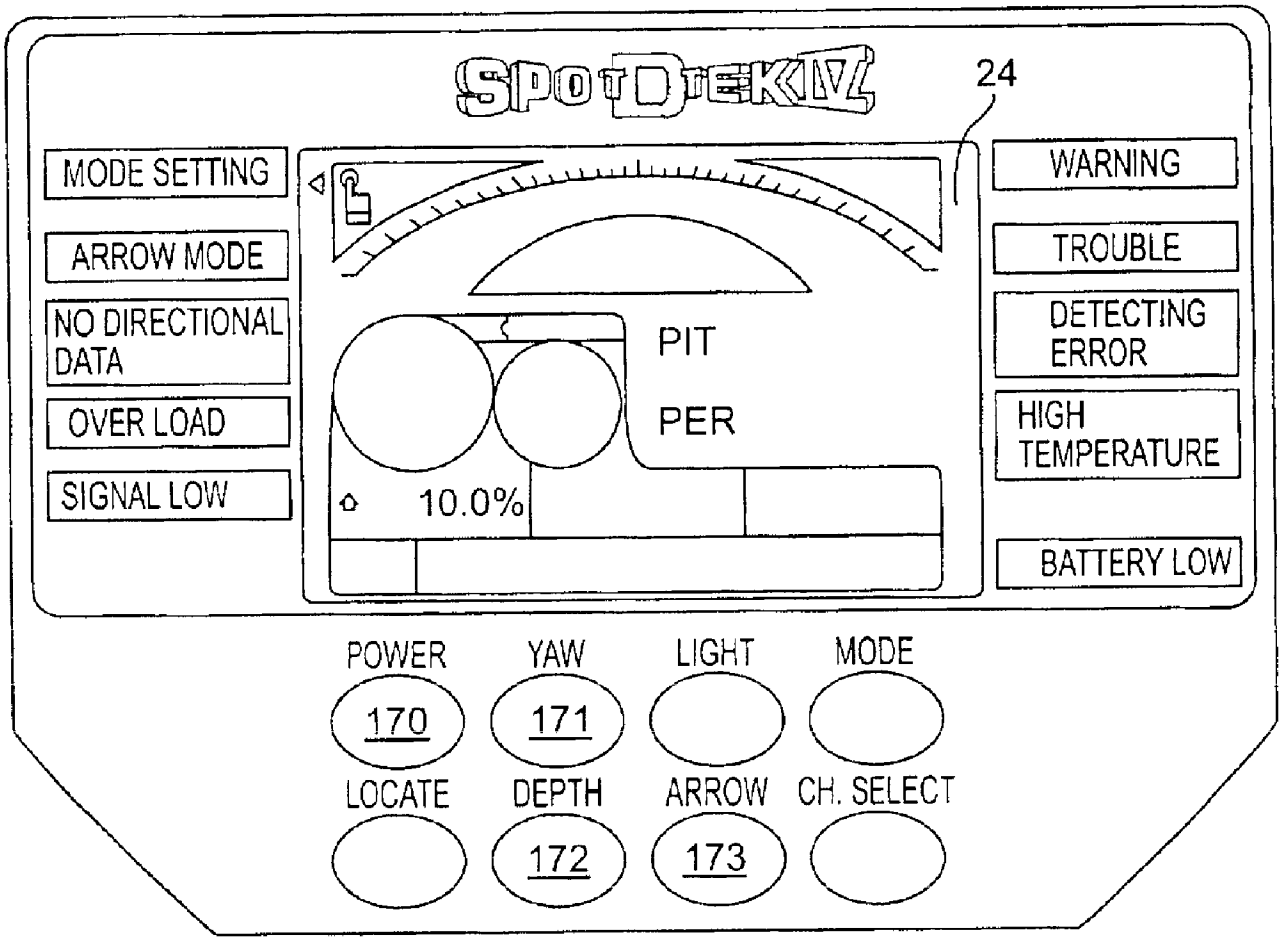
FIG. 12A is an exemplary visual display of a receiver and/or monitor device in accordance with an embodiment of the present invention.

If the operator wishes to switch the receiver to sewer probe mode, the operator then presses a depth button 172 located beneath yaw button 171, at step 162 This changes the pitch readout to a resolution of a hundredth (1/100) or a tenth (1/10) of a degree or a tenth (1/10) of a percent, as shown in FIG. 12A. Upon verifying that the pitch display includes one or more decimal positions at step 163, the operator stores the mode change in the receiver's EEPROM memory at 164 by powering the locator down and back up again. At this point, the receiver's microprocessor recognizes incoming probe signals as corresponding to the values shown in the table above and offsets these values by the calibration error discussed below.

Again, it should be understood that the receiver could be configured to switch modes without the power-down and power-up. In the presently described embodiment, however, the power down/up step helps prevent inadvertent changes to sewer probe mode and facilitates the programming change in the receiver.

It is also possible that the receiver is in sewer probe mode at start-up. If so, and if the operator wishes to remain in sewer probe mode, steps 161–164 may be omitted. If the operator wishes to change the receiver from sewer probe mode to standard probe mode at step 160, the procedure is similar to the switch from standard probe mode to sewer probe mode. The operator switches the receiver to setup mode by powering the receiver down and then powering up while simultaneously pressing the yaw button. Activating the depth button switches the display to the proper pitch resolution, and a subsequent power down and back up sets the receiver's microprocessor to standard probe mode so that the receiver's processor appropriately interprets signals from the probe.

At this point, whether the receiver is in the desired mode initially or has been switched to the desired mode, the operator may calibrate the probe and receiver for depth calculations as described above. Depth calibration does not depend on the pitch value, and there is, therefore, no difference in this procedure between the two types of probes. Once calibrated for depth, probe 30 (FIGS. 2B and 4 ) is placed in the boring head for use.

If the probe is a sewer probe, its alignment in the boring head is also calibrated. Although standard probes may also be calibrated for alignment in the manner described below, the present example of a calibration method is described with respect to sewer probes due to their higher resolution and relatively greater need for alignment precision. Initially, it is preferable to get the boring head as level as possible prior to inserting the probe. Accordingly, the boring head is first secured, for example in a vice, and leveled to horizontal using a digital level or its equivalent, if available. Once the boring head is aligned to horizontal, the probe is inserted into a cavity in the boring head at 165 in general alignment with the boring head's longitudinal axis, and the receiver displays the pitch. The probe's head should point toward the front of the boring head so that the pitch accelerometer is properly oriented.

Since the boring head is assumed to be level following the leveling step, a pitch reading of zero would indicate that the longitudinal axis of the probe's pitch accelerometer is also level and, therefore, aligned in exact coincidence with the boring head axis. Accordingly, the operator aligns the probe's longitudinal axis in the boring head cavity to make the pitch reading as close to zero as possible. "Alignment," as used herein, does not necessarily mean exact coincidence. For example, when aligning the boring head's longitudinal axis with horizontal using a level, it should be understood that there will typically be some error due to inherent error in the level and to imprecision in moving the boring head in a vise. Similarly, alignment of an accelerometer's measurement axis with horizontal using shims (discussed below) may minimize error but not necessarily eliminate it. Such error is, however, within a tolerance acceptable for the particular environment in which the boring system is used, for example as accommodated by an error offset as described herein.

To secure the probe in the boring head cavity at a desired alignment, the operator may shim the probe, for example by wrapping tape around the probe or applying shim material between the probe and the boring head cavity's surface. While monitoring the pitch reading displayed at the receiver, the operator adjusts the shim until minimizing the pitch reading, and therefore the alignment error, preferably to less then 0.4 percent from horizontal. Once the alignment error has been minimized, the probe is secured in the bore head by applying additional shim material so that the probe does not move during the drilling operation.

At 166, the operator places the receiver three feet away from the now-secured probe so that the probe is parallel to coil 23*a*(FIG. 2A). The distance between the probe and the receiver may vary but should accommodate for the components' operating characteristics. For example, in the presently described embodiment, the probe's output power level is less than 0.4 watts. To avoid over-driving the receiver in a preferred embodiment, the probe should be placed more than two feet away.

Figure 13:
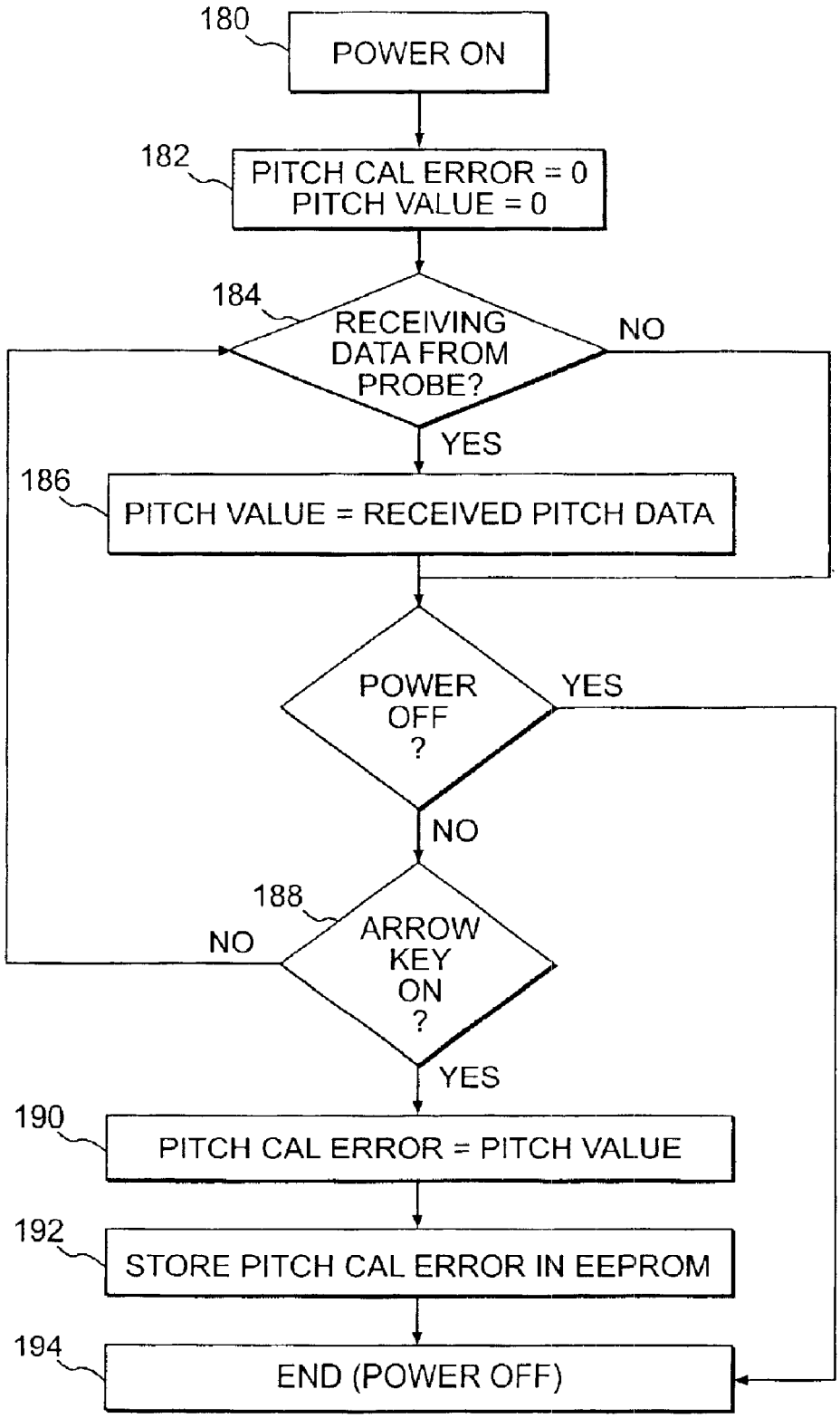
FIG. 13 is a flow diagram of a calibration measurement in accordance with an embodiment of the present invention.

Next, at step 167, the operator places the receiver in the calibration mode by (1) powering down the receiver, and (2) powering on the receiver while holding down arrow button 173. This sets the microprocessor to execute the calibration procedure indicated at 168 and illustrated in FIG. 13. Referring also to FIG. 13, arrow button 173 is released once the receiver powers back up at 180, and the receiver's display shows "CAL" over the term "PIT," indicating that the receiver is ready to calibrate the pitch angle setting. At 182, the receiver's processor zeros the calibration error value, "Pitch Cal Error," and the pitch angle measurement value, "Pitch Value." The receiver then checks at 184 whether data is being received from the probe.

Figure 12B:
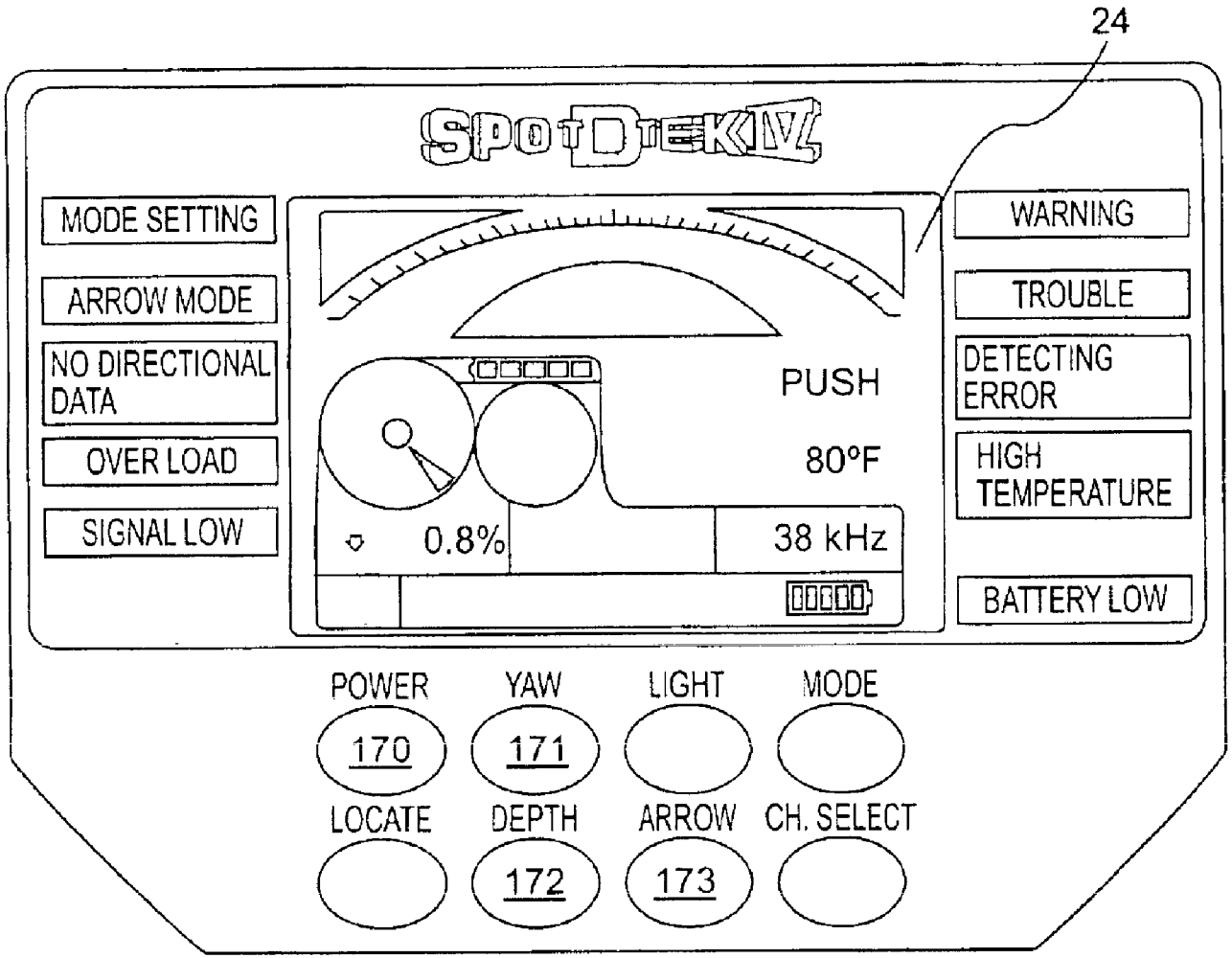
FIG. 12B is an exemplary visual display of a receiver and/or monitor device in accordance with an embodiment of the present invention.
Figure 12C:
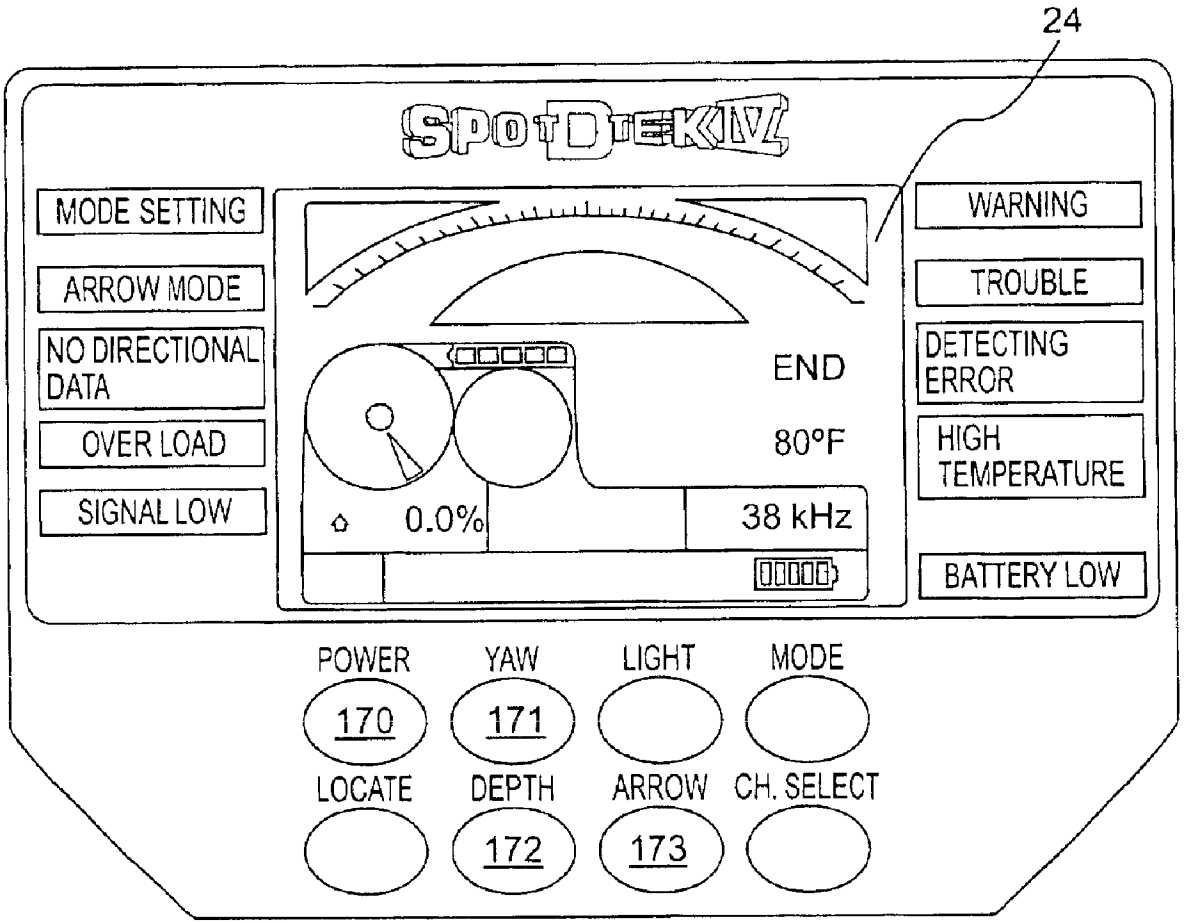
FIG. 12C is an exemplary visual display of a receiver and/or monitor device in accordance with an embodiment of the present invention.

Two seconds after power up, as shown in FIG. 12B, the terms "CAL" and "PIT" disappear. If the receiver is receiving data at 184, the receiver converts the incoming code number to a pitch angle, which is stored as Pitch Value at 186, and the receiver's display shows the pitch (0.8% in the example shown in FIG. 12B). This represents the alignment error, including both the error in aligning the boring head with horizontal and the error in aligning the accelerator's sensitive axis with the boring head's longitudinal axis. Since the boring head in this position is considered to be in an acceptable "horizontal" position, this pitch value represents the error in the pitch reading.

The terms "PUSH" and "ARROW" alternate on display 24, indicating that the user should push arrow button 173 to calibrate the reading If the operator pushes arrow button 173, the receiver's microprocessor senses this at 188 and sets Pitch Cal Error to the present value of Pitch Value (0.8% in this example) at 190. The processor stores Pitch Cal Error in the receiver's EEPROM at 192, and the display indicates (FIG. 13C) the end of the calibration process. The operator powers the receiver off and back on again at 194 to take the receiver out of calibration mode.

Thereafter, during operation, the receiver offsets the pitch accelerometer's measurements by the saved pitch error. As pitch measurements are received, the processor reads the code number transmitted by the probe, converts the code number to the pitch angle according to Table 1, and then offsets the angle by the stored error. For example, if the pitch error is 0.8% when the probe transmits "108, " the receiver offsets the table value (9.4%) by 0.8, and the receiver displays 8.6%. If the probe transmits "2," the receiver displays −0.6%. If the probe transmits "−124," the receiver displays −20.8%. The stored calibration error is saved in the EEPROM until the receiver is recalibrated.

It should be understood that modifications and variations of the present invention may be practiced by those of ordinary skill in the art without departing from the spirit and scope of the present invention, which is more particularly set forth in the appended claims. Furthermore, those of ordinary skill in the art will appreciate that the foregoing description is by way of example only, and is not intended to limit the invention so further described in such appended claims, and that the aspects of varying embodiments may be interchanged in whole or in part.

What is claimed is:

1. A method for calibrating a horizontal underground bore location system, said method comprising the steps of:

a. aligning a probe in a bore head, said probe having a pitch sensor that measures deviation between a first predetermined orientation and a measurement axis defined by the pitch sensor and having a transmitter that radiates an electromagnetic signal that carries the deviation measured by the pitch sensor, by aligning a longitudinal axis of the bore head with said first predetermined orientation and placing the probe into the bore head and aligning said measurement axis with said first predetermined orientation by adjusting the probe's position in the bore head;

b. providing a receiver that receives the electromagnetic signal and detects said measured deviation;

c. aligning the receiver in a second predetermined orientation with respect to the probe;

d. measuring said deviation between said first predetermined orientation and said measurement axis in cooperation with adjusting the probe's position in the bore head to minimize the deviation;

e. receiving, at the receiver, the electromagnetic signal radiated from the probe and deriving said deviation measured at step (d) therefrom; and f. after minimizing the deviation, storing said deviation derived at step (e) in memory as a calibration error.

2. The method as in claim 1, wherein said bore head is a boring head.

3. The method of claim 1, including, following step (t), offsetting deviation measurements thereafter detected by said receiver from said probe by said calibration error.

4. The method as in claim 1, wherein the pitch sensor includes an accelerometer.

5. A method for calibrating a horizontal underground bore location system, said method comprising the steps of:

a. aligning a probe in a boring head, said probe having a pitch sensor that measures deviation between a first predetermined orientation and a measurement axis defined by the pitch sensor and having a transmitter that radiates an electromagnetic signal that carries the deviation measured by the pitch sensor;

b. aligning the probe in a second predetermined orientation with respect to a receiver;

c. measuring said deviation between said first predetermined orientation and said measurement axis;

d. receiving, at the receiver, the electromagnetic signal radiated from the probe and deriving said deviation measured at step (c) therefrom; and e. storing said deviation derived at step (d) in memory as a calibration error.

6. The method of claim 5, wherein step (a) further includes aligning a longitudinal axis of the boring head with said first predetermined orientation.

7. The method of claim 6, wherein step (a) further includes placing the probe into the boring head and aligning said measurement axis with said first predetermined orientation.

8. The method of claim 7, wherein the last-mentioned aligning step of step (a) includes adjusting the probe's position in the boring head, while monitoring said deviation derived at step (d), until minimizing the monitored deviation.

9. The method of claim 5, including, following step (e), offsetting deviation measurements thereafter detected by said receiver from said probe by said calibration error.

10. The method as in claim 9, wherein the pitch sensor includes an accelerometer.

11. A method for calibrating a pitch measurement of a horizontal underground bore location system, said method comprising the steps of:

a. providing a probe having a pitch sensor that measures deviation between a predetermined orientation and a measurement axis defined by the pitch sensor and having a transmitter that outputs an electromagnetic signal that carries the deviation measured by the pitch sensor;

b. providing a receiver that detects the signal output by the probe and having receiver circuitry that derives said deviation from the detected signal;

c. aligning a bore head with the predetermined orientation;

d. placing the probe in the bore head and aligning the measurement axis with the predetermined orientation by adjusting the probe's position in a cavity of the bore head; and e. following step (d), causing the receiver to derive said deviation when the bore head is aligned with the predetermined orientation from step (c) and monitoring said deviation in cooperation with adjusting the probe's position until the monitored deviation is minimized;

f. wherein, following step (e), the receiver offsets deviation measurements thereafter detected from the probe by the deviation measured at step (e).

12. The method as in claim 11, wherein the bore head is a boring head.

13. The method as in claim 11, wherein the pitch sensor includes an accelerometer.

14. The method as in claim 13, wherein the pitch sensor reacts to an acceleration force of 0.001 g or less.

15. The method as in claim 14, wherein the probe includes circuitry that derives said deviation from samples of an output signal from the accelerometer, wherein the probe circuitry samples the accelerometer at a rate of approximately 24 samples/second over at least a three second sampling period.

16. The method as in claim 11, wherein the predetermined orientation is horizontal.

17. A method for calibrating a pitch measurement of a horizontal underground bore location system, said method comprising the steps of:

a. providing a probe having a pitch sensor that measures deviation between horizontal and a measurement axis defined by the pitch sensor and having a transmitter that radiates an electromagnetic signal that carries the deviation measured by the pitch sensor;

b. providing a receiver having at least one antenna that derives the signal radiated by the probe and having receiver circuitry that derives said deviation from a signal output from the antenna;

c. aligning a bore head with the predetermined orientation;

d. placing the probe in the bore head and aligning the measurement axis with horizontal by adjusting the probe's position in the bore head;

e. following step (d), causing the receiver to derive the pitch sensor's deviation from horizontal when the bore head is aligned with horizontal from step (c) in cooperation with adjusting the probe's position in the bore head to minimize the deviation; and f. wherein, following step (e), the receiver offsets deviation measurements thereafter detected from the probe by the deviation measured at step (e).

18. A method for calibrating a pitch measurement of a horizontal underground bore location system, said method comprising the steps of:

a. providing a probe having a pitch sensor that measures deviation between a predetermined orientation and a measurement axis defined by the pitch sensor and having a transmitter that radiates an electromagnetic signal that carries the deviation measured by the pitch sensor, wherein the pitch sensor includes an accelerometer that reacts to an acceleration force of 0.001 g or less and wherein the probe includes circuitry that derives said deviation from samples of an output signal from the accelerometer at a resolution of at least 0.05 degrees;

b. providing a receiver having at least one antenna that derives the signal radiated by the probe and having receiver circuitry that derives said deviation from a signal output from the antenna;

c. aligning a boring head with the predetermined orientation;

d. placing the probe in the boring head and aligning the measurement axis with the predetermined orientation;

e. while monitoring said deviation derived by the receiver, adjusting the probe's position in a cavity of the boring head until minimizing the monitored deviation; and f. causing the receiver to detect the deviation minimized at step (e);

g. wherein, following step (f), the receiver offsets deviation measurements thereafter detected from the probe by the minimized deviation.

19. The method as in claim 18, wherein the predetermined orientation is horizontal.

* * * * *